US009238231B2

(12) United States Patent
Yoon et al.

(10) Patent No.: US 9,238,231 B2
(45) Date of Patent: Jan. 19, 2016

(54) FLOTATION MACHINE ROTOR

(75) Inventors: Roe-Hoan Yoon, Blacksburg, VA (US); Gerald Luttrell, Blacksburg, VA (US); Saad Ragab, Blacksburg, VA (US); Demetri Telionis, Blacksburg, VA (US); Abdel-Halim Said, Zagazig (EG); Sanja Miskovic, Salt Lake City, UT (US); Aaron Noble, Lenoir City, TN (US); Yihong Yang, Salt Lake City, UT (US)

(73) Assignee: Virginia Tech Intellectual Properties, Inc., Blacksburg, VA (US)

( * ) Notice: Subject to any disclaimer, the term of this patent is extended or adjusted under 35 U.S.C. 154(b) by 674 days.

(21) Appl. No.: 13/535,566

(22) Filed: Jun. 28, 2012

(65) Prior Publication Data

US 2014/0001103 A1 Jan. 2, 2014

(51) Int. Cl.

| | |
|---|---|
| ***B03D 1/16*** | (2006.01) |
| ***B03D 1/20*** | (2006.01) |
| ***B01F 3/04*** | (2006.01) |
| ***B01F 7/16*** | (2006.01) |
| ***B01F 7/18*** | (2006.01) |
| ***B01F 7/00*** | (2006.01) |

(52) U.S. Cl.

CPC ..... *B03D 1/20* (2013.01); *B01F 3/04539* (2013.01); *B01F 7/00241* (2013.01); *B01F 2003/04546* (2013.01); *B01F 2003/04567* (2013.01)

(58) Field of Classification Search

USPC ..... 209/169

See application file for complete search history.

(56) References Cited

U.S. PATENT DOCUMENTS

| | | | | |
|---|---|---|---|---|
| 2,544,301 | A * | 3/1951 | Delbert et al. | 416/227 R |
| 3,843,101 | A * | 10/1974 | Green | 366/265 |
| 4,425,232 | A | 1/1984 | Lawrence et al. | |
| 4,800,017 | A | 1/1989 | Krishnaswamy et al. | |
| 5,205,926 | A | 4/1993 | Lawrence | |
| 6,789,788 | B2 | 9/2004 | Belke | |
| 6,805,243 | B1 | 10/2004 | Kallioinen et al. | |
| 7,980,824 | B2 | 7/2011 | Niitti | |
| 2008/0063523 | A1 | 3/2008 | Niitti | |

FOREIGN PATENT DOCUMENTS

| | | | |
|---|---|---|---|
| CN | 2912802 Y | * | 6/2007 |
| EA | 014815 B1 | | 2/2011 |
| FR | 1474582 | * | 3/1967 |
| GB | 1028590 | | 5/1966 |
| SU | 599848 | * | 4/1978 |
| SU | 747530 | * | 7/1980 |
| SU | 852366 A1 | * | 8/1981 |
| SU | 1745342 A1 | * | 7/1992 |
| WO | 9706892 | | 2/1997 |

OTHER PUBLICATIONS

European Search Report for PCT/US2013/040057 dated May 26, 2015.

International Search Report of PCT/US2013/040057 dated Sep. 12, 2013.

Written Opinion of the International Searching Authority of PCT/US2013/040057 dated Sep. 12, 2013.

* cited by examiner

*Primary Examiner* — Thomas M Lithgow

(74) *Attorney, Agent, or Firm* — Buchanan Ingersoll & Rooney PC

(57) ABSTRACT

A rotor for flotation machines or flotation cells of flotation machines includes blades that are configured to provide improved bubble flow and bubble generation performance while also reducing the power requirements for rotating the rotor to generate bubble flow within a tank of a flotation cell used to generate froth. Embodiments of the rotor may also be configured to be smaller than conventional rotor designs, which may help reduce the costs of manufacturing the rotor or flotation machines using such embodiments of the rotor.

22 Claims, 9 Drawing Sheets

FLOTATION MACHINE ROTOR

FIELD OF INVENTION

The present invention relates to devices and methods used to agitate slurry retained in flotation machines. One example of a flotation machine is a machine that utilizes one or more flotation cells that have tanks that retain a slurry, or pulp, to recover particles of material such as ore, minerals, metal, or other material that is within solid material suspended in a liquid of the slurry, or pulp.

BACKGROUND OF THE INVENTION

Flotation machines often include a tank that retains a slurry, or pulp. Examples of such machines may be appreciated from U.S. Pat. Nos. 4,425,232, 4,800,017, and 5,205,926. The entirety of U.S. Pat. Nos. 4,425,232, 4,800,017, and 5,205,926 are incorporated by reference herein. The slurry retained by such tanks may include solid material such as ore or minerals that is mixed in a liquid such as water. For example, the material present in the slurry may include particles of copper bearing minerals, coal, iron minerals, phosphate rock, potash, silica, base metal sulfide or precious metal.

The slurry retained in the tank may be aerated to generate froth to suspend solid particles in the froth. The froth may be a large amount of bubbles formed at the top of the slurry in the tank. For instance, froth may be generated via a forced air technology to create bubbles and generate the froth. Alternatively, bubbles may be generated via a self-aspirated technology to create the froth. The tanks are designed so that the froth, which contains the solid particles, may be passed into one or more launders adjacent to the tank to separate the valuable minerals from the other liquid and other material. It should be understood that after the material is sent to the one or more launders, it may be further processed to recover the desired material.

Rotors may be included in each flotation cell of a flotation machine to agitate the slurry for purposes of forming air bubbles that capture particles and rise to the top of the slurry to form froth. Air may be forced through the rotor and expelled out adjacent blades located at the bottom of the rotor that is rotated so that air is mixed with the slurry to generate bubbles for forming the froth above the slurry retained in the tank. Such a froth so generated, however, may be difficult to maintain unless the rotor is rotated at relatively fast speed and may also require a rotor to be relatively large. Such size and speed constraints increase the cost of fabricating such flotation machines and operating such machines.

Further, such rotors typically include blades that generate a velocity spike in an exit stream of slurry that consumes a relatively significant amount of power used to rotate the rotor but fails to provide any meaningful improvement to froth formation performance. This design feature also increases the costs associated with operating the flotation machines.

A new rotor design is needed for flotation cells of flotation machines. The new rotor design preferably reduces the cost of manufacturing rotors and reduces the operating costs associated with moving of the rotors during operation of the flotation cells. Preferably, such a rotor design also improves the bubble generation performance of the rotors as compared to conventional rotors.

SUMMARY OF INVENTION

A flotation machine and flotation machine rotor are provided that can provide improved mineral recovery performance and reduced operating costs as compared to conventional designs.

In one embodiment, the flotation machine includes at least one flotation cell. Each flotation cell includes a tank that is sized to retain slurry comprised of a liquid mixed with at least one solid material and a rotor positioned in the tank that is rotated to agitate the slurry to facilitate formation of bubbles. The rotor includes a body that has outer blades that extend outwardly from the body, an inner channel, inner blades positioned adjacent the inner channel and a plurality of conduits in communication with the inner channel. Each of the conduits extends from the inner channel to an external surface of the body so that the slurry pulled into an opening of the body via rotation of the rotor passes through the inner channel and is ejected, or emitted, from the external surface of the body via the conduits.

In other embodiments, the rotor of the flotation machine includes a rotor positioned in the tank that is rotated to agitate the slurry to facilitate formation of a bubbly flow used to generate froth. The rotor is attached to a column and includes a body having a plurality of outer blades that extend outwardly from the body. Each of the outer blades has an outer edge that extends outwardly from an upper portion of the rotor to an outermost position located below the upper portion of the rotor. The outer edge extends inwardly from the outermost position to which the outer edge extends to a lower portion of the rotor. The lower portion of the rotor is located below the outermost position to which the outer edge extends and is positioned inward relative to the outermost position of the outer edge.

Embodiments of a rotor for flotation machines are also provided. One embodiment of the rotor includes a body that has outer blades that extend outwardly from the body, an inner channel, inner blades positioned adjacent the inner channel and a plurality of conduits in communication with the inner channel. Each of the conduits extends from the inner channel to an external surface of the body so that the slurry pulled into an opening of the body via rotation of the rotor subsequently passes through the inner channel and is then ejected, or emitted, from the external surface of the body via the conduits.

The body of the rotor may also include passageways for receiving at least one gas such as air. Each of the passageways may include an inlet to receive at least one gas and an outlet to emit the at least one gas received via the inlet. The outlet of each passageway is spaced apart from the outlets of other passageways. The outlet of each passageway may be positioned in the body between immediately adjacent outer blades. The outer blades may be spaced apart from one another along the external surface of the body of the rotor and the inner blades may be spaced apart from each other and may at least partially define the conduits.

The body of the rotor may be formed so that the inner blades and outer blades are integral with the body or are attached to the body. In one embodiment, the inner blades may be formed by casting or molding the body of the rotor and the outer blades may be welded to the rotor body or formed when the rotor body is casted or molded. The outer blades may be offset relative to the inner blades. The body may be structured in some embodiments so that no gas is injected into the inner channel of the body.

Other embodiments of the rotor for flotation machines can include a plurality of outer blades that extend outwardly from the body. Each of the outer blades has an outer edge that extends outwardly from an upper portion of the rotor to an outermost position located below the upper portion of the rotor. The outer edge extends inwardly from the outermost position to which the outer edge extends to a lower portion of the rotor. The lower portion of the rotor is located below the outermost position to which the outer edge extends and is positioned inward relative to the outermost position of the outer edge.

The outer edges of the outer blades may be curved. In some embodiments of the rotor, the outer edges define smooth outer surfaces of the outer blades and at least partially define the shape of the outer blades so that the outer blades are each generally half-heart shaped. The rotor may also include one or more outlets for emitting air. Each outlet may be positioned between immediately adjacent outer blades.

In one embodiment, the lower portion of the rotor is the bottom of the rotor and the outer blades are sized and shaped so that the rotor suppresses a velocity spike in an exit stream of agitated slurry formed via rotation of the rotor. Preferably, the rotor is shaped so that rotation of the rotor at steady state defines a uniform turbulence profile within the slurry.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of flotation machines that utilize embodiments of rotors that rotate for generating froth in flotation cells of such machines, embodiments of the rotor and methods of making and using the same are shown in the accompanying drawings. It should be understood that like reference numbers used in the drawings may identify like components.

DETAILED DESCRIPTION OF PRESENT PREFERRED EMBODIMENTS

Figure 1:
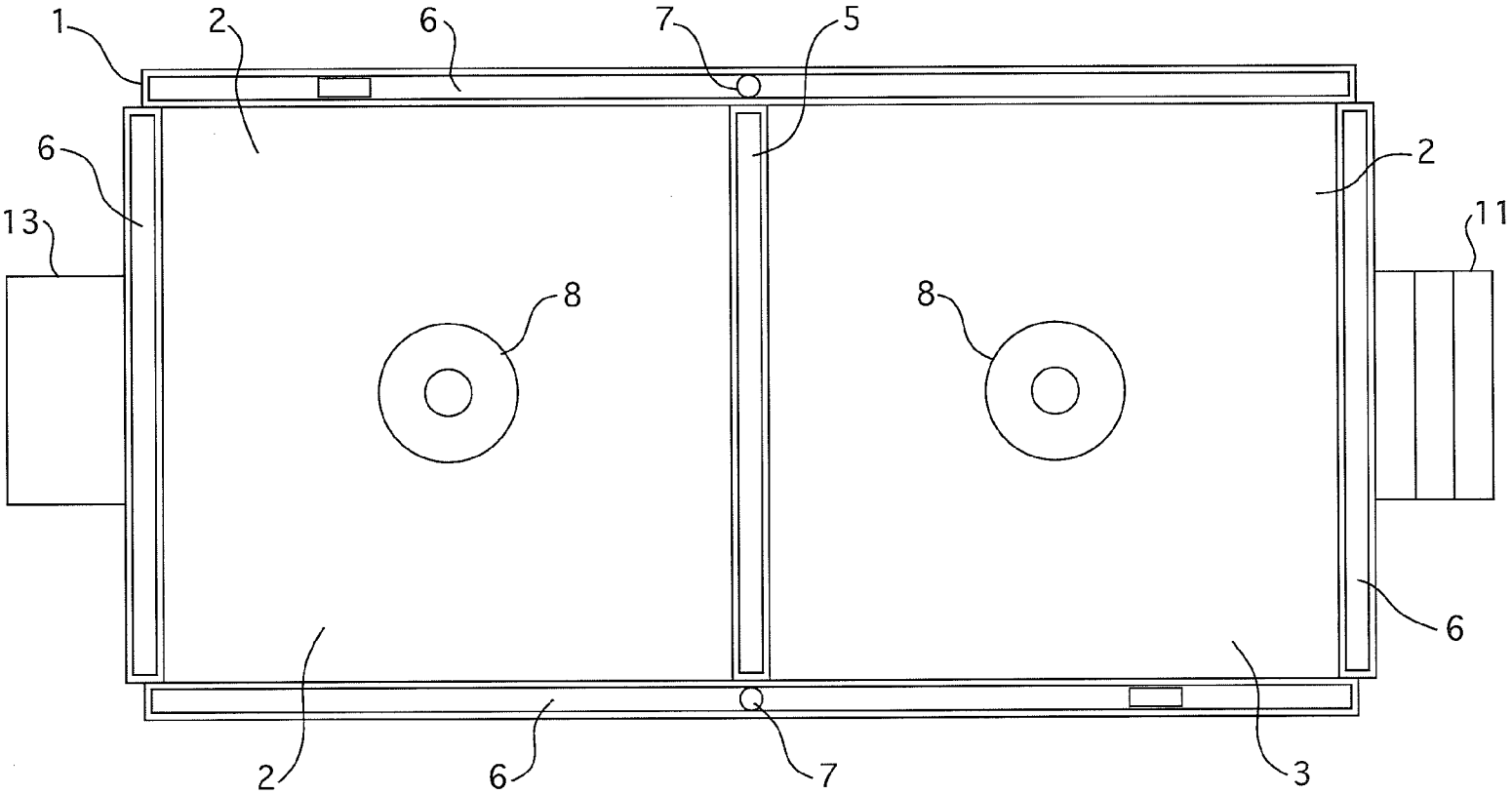
FIG. 1 is top schematic view of an exemplary flotation machine that may utilize one or more embodiments of the rotor.
Figure 2:
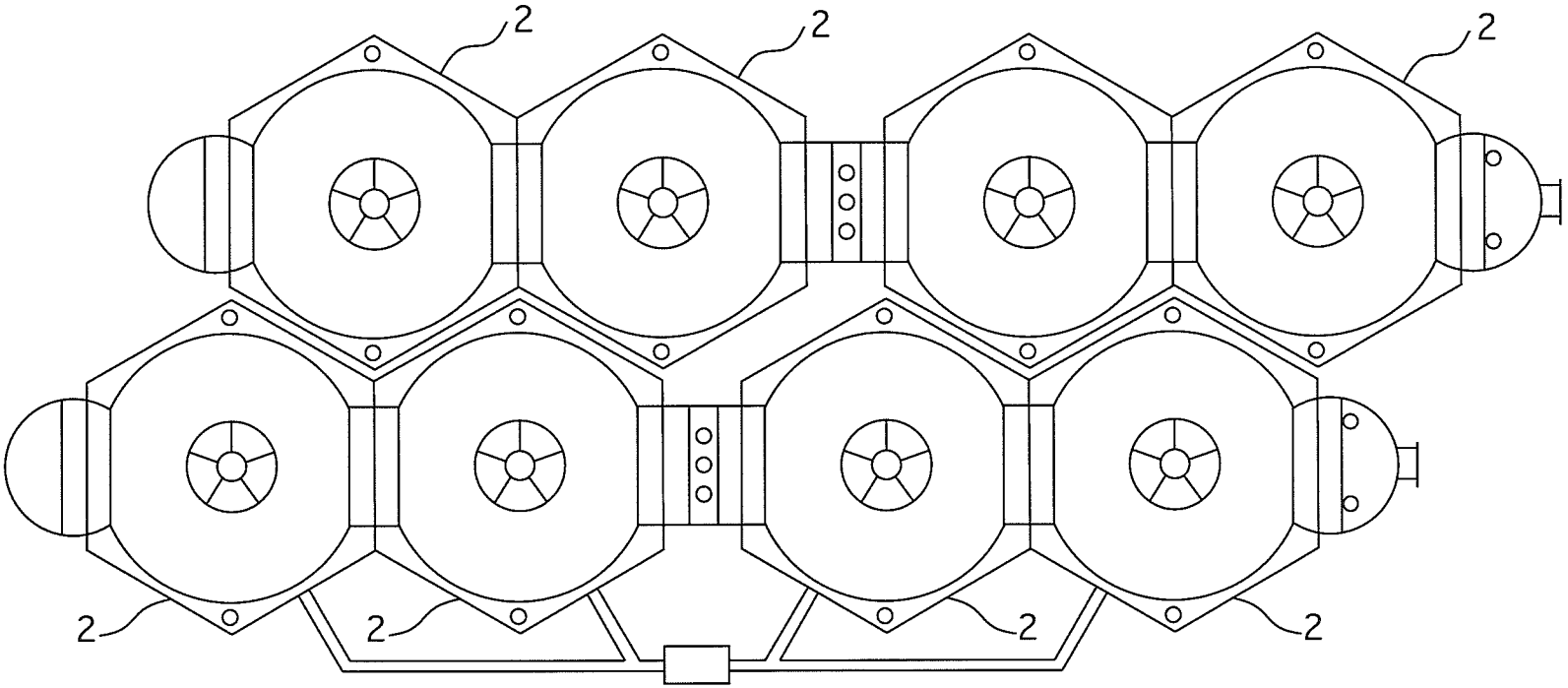
FIG. 2 is a top schematic view of another exemplary flotation machine that may utilize one or more embodiments of the rotor.

Referring to FIGS. 1 and 2, a flotation machine 1 used to recover minerals from slurry may have a plurality of flotation cells 2. The number of flotation cells used in embodiments of the flotation machine 1 may range from one cell to a large number of cells. The number of cells needed for any particular flotation machine may be dependent on design requirements for the mineral or material recovery that the flotation machine is designed to meet. In some embodiments, the flotation machine may be a flotation column.

For example, a flotation machine may include a number of cells that are Dorr-Oliver® unit cells to process finely sized particles and cells upstream or downstream of these cells may be WEMCO® or MixedRow™ cells for larger sized particle recovery such as middlings. Of course, it should be understood that other type of cells could be used as substitutes of the above referenced Dorr-Oliver®, WEMCO®, or MixedRow™ cells.

Each flotation cell 2 has a tank that retains slurry, which may also be referred to as pulp, within the tank 3. The tank 3 may have any of a number of different shapes. For example, each tank 3 may be shaped similarly to a large rectangular tank or may be a generally cylindrical tank as may be appreciated from U.S. Pat. No. 5,205,926 (the entirety of which is incorporated by reference herein).

A feed box 13 may be adjacent to one or more of the flotation cells 2 and may be where material is mixed with liquid to form the slurry, or pulp, that is subsequently fed into the tanks 3 of the cells 2. The liquid may be water, salt water, or a solution. The material that is mixed with the liquid may include rock, stone or dirt that includes one or more minerals or metals that are desired to be recovered from the material.

Froth may be generated in the tank above the slurry retained in the tank by a rotation mechanism 8 that is positioned in the tank 3 of a flotation cell. The rotation mechanism 8 may include a column that is attached to a rotor. Air or another type of gas or mixture of gases may be forced through the column and the rotor so that air is ejected from the rotor to help facilitate agitation of the slurry and formation of the bubbles. The column may be positioned so that the rotor is near the bottom of the tank, at the bottom of the tank, or in another position within the tank that is desirable for generating bubbles sufficiently to form a froth for the particular mineral recovery process a flotation cell of the flotation machine may be configured to meet. The column may a part of a drive mechanism or attached to a drive mechanism so that the column may be rotated to rotate the rotor in the slurry to agitate the slurry within the tank to generate bubbles. The rotor of the rotation mechanism 8 may have any of a number of different designs as discussed more fully below with reference to FIGS. 3-8. The bubbles that are formed float upwardly within the tank and accumulate on the top of the slurry to form a foam. Often, water or other liquid of the slurry may drain back into the slurry when the foam is formed at the top of the slurry. When solid particles of the slurry are trapped in the bubbles that form the foam, the foam is referred to as a froth.

Launders 6 may be positioned on the top lips of the tank or adjacent the top lips of each tank around at least some of the sides of the tank 3 of each flotation cell 2 to receive froth that may flow over the sides of the tank. The launders 6 may have discharge outlets 7 for discharging froth received by the launders. The discharged froth may then be processed to separate the fine particles of the material that is within the froth to extract, or recover, desirable portions of this material, such as metal, a mineral, or other desirable material. A cross launder 5 may be positioned between the adjacent flotation cells 2 to divide the cells 2.

Figure 3:
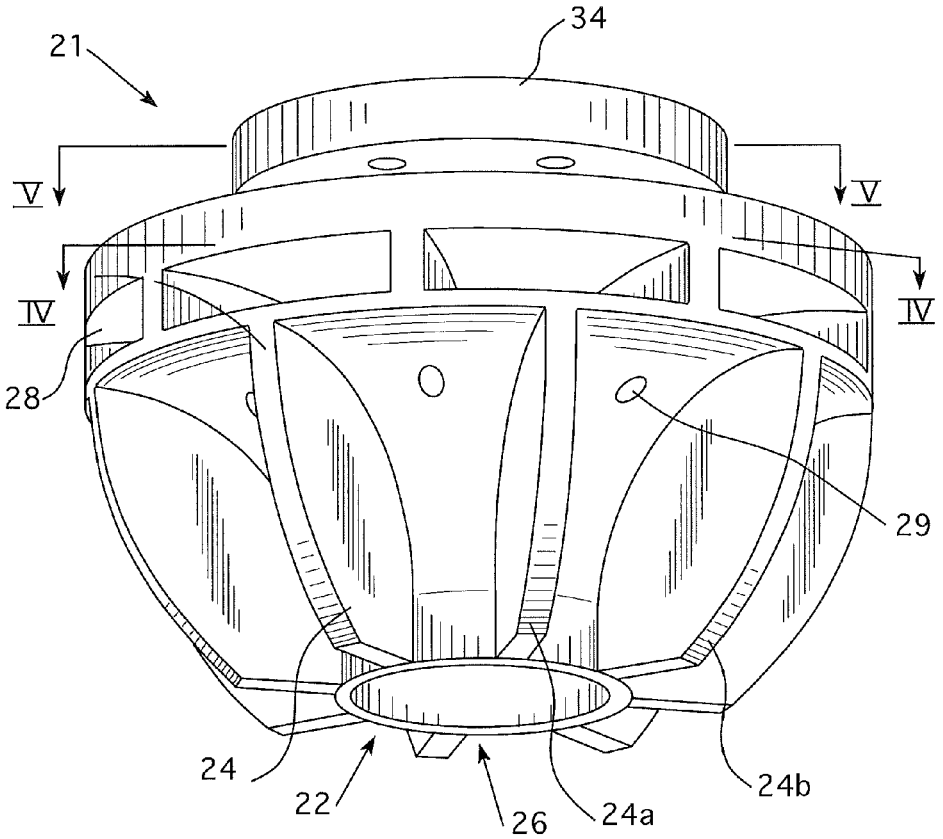
FIG. 3 is a perspective view of a first exemplary embodiment of a rotor.
Figure 4:
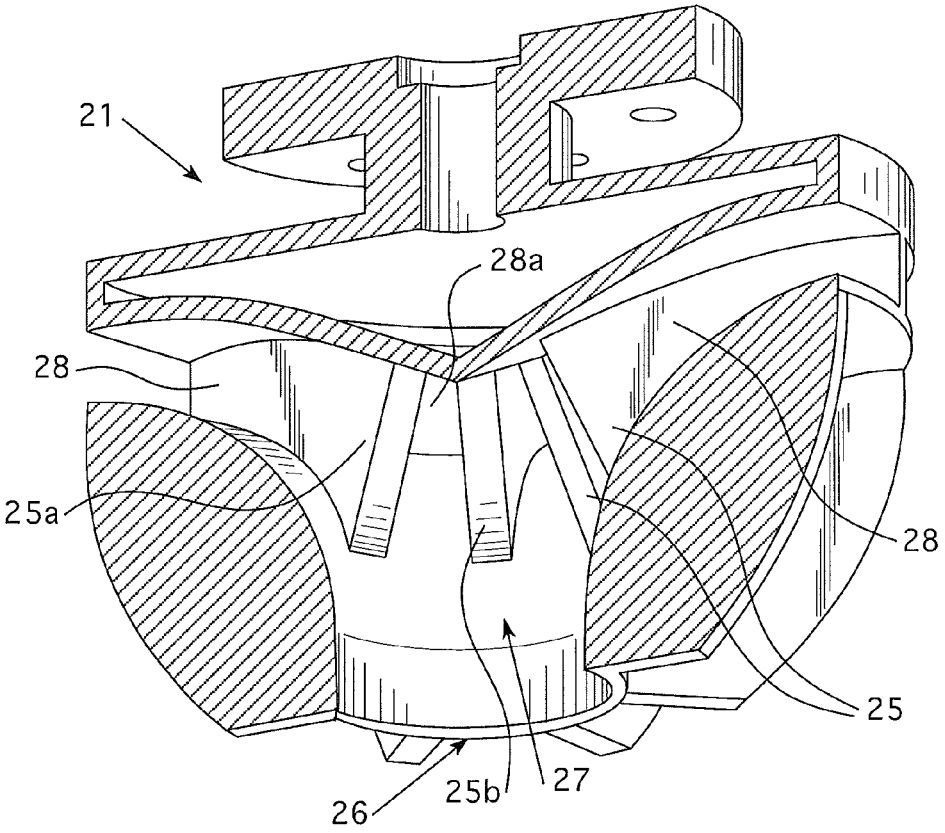
FIG. 4 is a perspective cross sectional view of the first exemplary embodiment of the rotor taken along line IV-IV in FIG. 3.
Figure 5:
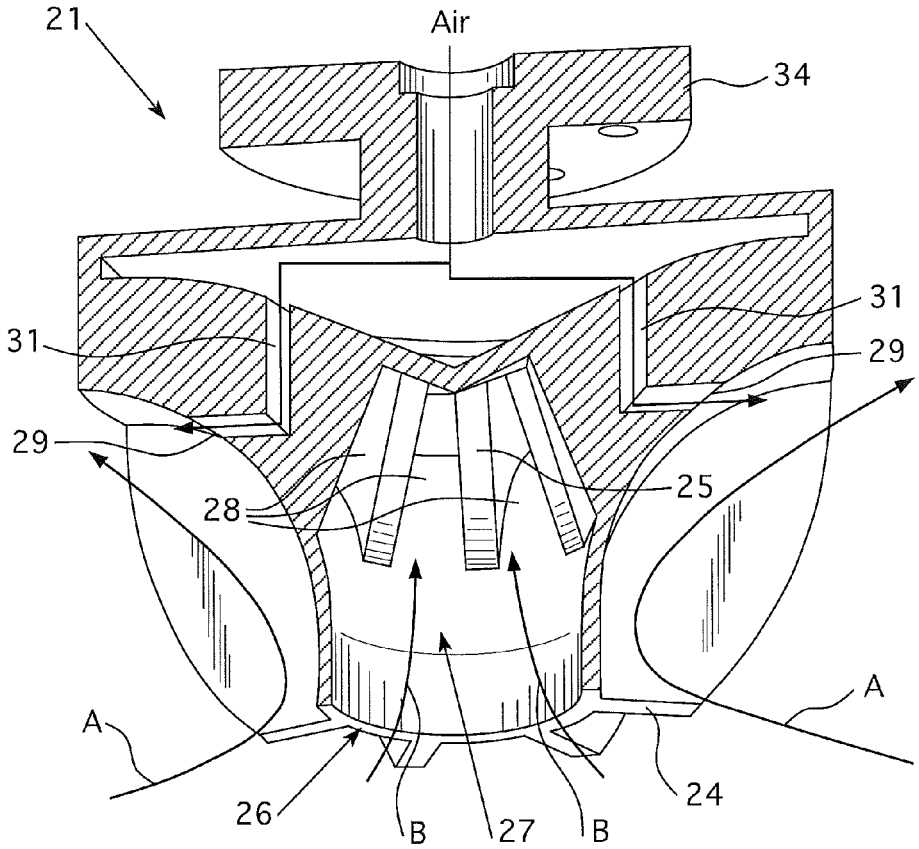
FIG. 5 is a cross sectional view of the first exemplary embodiment of the rotor taken along line V-V in FIG. 3 that includes indicia illustrating slurry and gas flows that may be generated by the rotor when the rotor is rotated.
Figure 6:
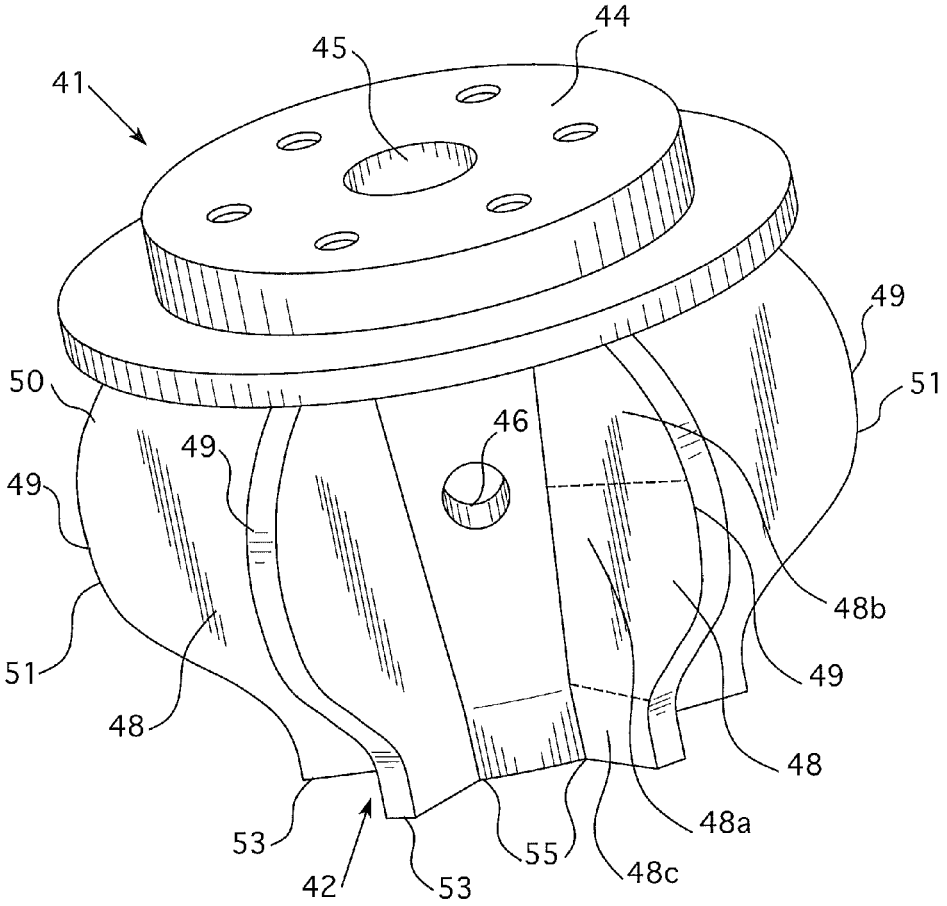
FIG. 6 is a perspective view of a second exemplary embodiment of a rotor.
Figure 7:
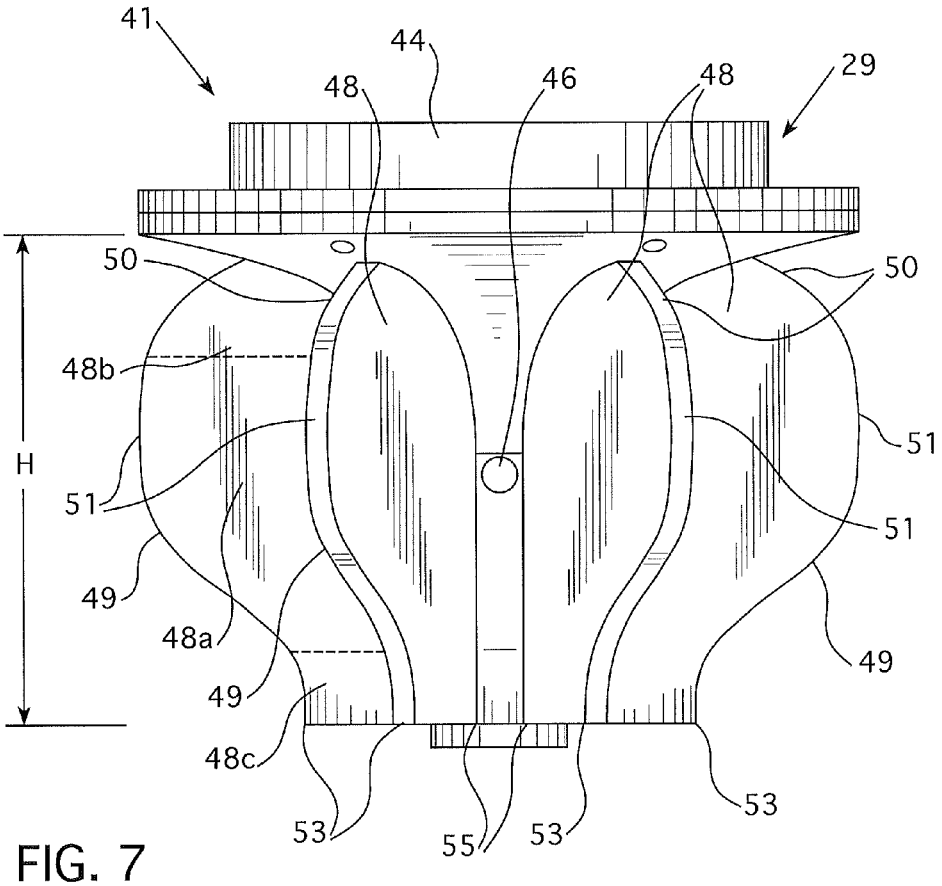
FIG. 7 is a side perspective view of the second exemplary embodiment of the rotor.

Referring to FIGS. 3-5, one embodiment of a rotor 21 that may be used in embodiments of the flotation machine include rotor 21. Rotor 21 has a body 22 that has an upper portion sized and configured for attachment to a column of a rotation mechanism 8. The body 22 includes outer blades 24 that extend from the body. The outer blades may be members such as projecting walls, plates, or profiled fins that agitate the slurry in the tank when the rotor 21 is rotated. The outer blades 24 may be formed on the body, adhered to the body, cast with the body, integrally attached to the body or otherwise attached to the body via one or more fastening mechanisms such as welding, rivets, or other fasteners.

The body 22 of the rotor 21 may be formed from metal and have an opening 26 formed therein at the bottom of the rotor below the outer blades 24 or adjacent the bottom of the outer blades 24. An inner channel 27 may be formed in the body 22 that is in communication with the opening 26 so that slurry may pass through the opening 26 and into the inner channel 27. A plurality of inner blades 25 are attached to the body 22. For instance, the inner blades 25 may be attached such that the inner blades are integral with the body 22 or are defined in the body 22. The inner blades 25 are positioned adjacent to the inner channel 27 or in the inner channel 27. The inner blades may be members such as plates, inwardly projecting walls, or other structure that is positioned in the body adjacent the inner channel to provide a pumping force or pressure differential, for pulling slurry into the inner channel 27 via opening 26 and out of conduits 28 when the rotor 21 is rotated.

The conduits 28 may be formed in the body 22 and be at least partially defined by the body 22. Immediately adjacent inner blades 25 may also partially define the conduits 28 along with portions of the body 22. For instance, immediately adjacent inner blades 25*a* and 25*b* in combination with the body 22 may define conduit 28*a* as shown in FIG. 4. It should be understood that inner blades 25 may be considered immediately adjacent if no other inner blade is positioned between two adjacent inner blades located adjacent to or along a periphery of the inner circumference 27. The conduits 28 are in communication with the inner channel 27 so that slurry that passes into the inner channel 27 via opening 26 passes from the inner channel 27 and through inlets of the conduits 28 to be expelled out of the outlets of the conduits 28 located on the exterior surface of the body 22 of the rotor 21. The inlets of the conduits may interface with the inner channel 27 and the outlets may be formed in the body 22 of the rotor in the exterior surface of the body. Each of the outlets of the conduits 28 are preferably positioned above the outer blades 24.

The body 22 of the rotor 21 may also include a plurality of passageways 31 that are sized to receive air or other gas forced through a column attached to the rotor 21 for expelling out of the rotor body 22 by the outer blades 24. The passageways 31 may include an inlet for receiving air and may be formed in the body 22 of the rotor 21 so that the receive air passes through the passageways 31 and out of outlets 29 of the passageways 31. Each outlet 29 of a passageway is preferably spaced apart from other outlets 29 and each outlet 29 is preferably positioned between two immediately adjacent outer blades 24. For instance, as may be seen in FIG. 4, blades 24*a* and 24*b* may be considered to be immediately adjacent. It should be understood that outer blades 24 may be considered immediately adjacent if no other outer blade is positioned between two adjacent outer blades along a periphery of the rotor body 22.

The outer blades 24, inner blades 25 and rotor body 22 may be sized and shaped so that rotation of the rotor forces slurry along flows A and B shown in FIG. 5. Air may be passed through the passageways 31 so that the air flows along flow path C shown in FIG. 5. No air may be combined with the slurry of flow B that passes through the inner channel 27 and conduits 28. The slurry passed out of the conduits is expelled above the slurry and air mixed together via air flow C emitted from outlets 29 and slurry flow A generated by rotation of the outer blades 24. The air flow C being positioned between the combination of slurry flows A and B such that large gas bubbles cannot escape without breaking into smaller bubbles that must collide with particles in the slurry flows A and B. The layering of slurry flows A and B and air flow C created by the rotor 21 may be referred to as an "air sandwich."

Thus slurry flow B is denser because the slurry flow B is not mixed immediately with air as the slurry flow A because slurry flow A is generated by the outer blades 24 while air is expelled from outlets 29 positioned between immediately adjacent outer blades 24. In embodiments where the conduits 28 feed the slurry flow B out above the air flow C passing out of outlets 29 and slurry flow A generated from the rotation of the outer blades 24, the rotor triggers "Rayleigh-Taylor" instability that enhances slurry gas mixing. Further, small bubbles that could recirculate back to the rotor are more likely to be drawn in by the conduits 28, which may improve the pumping capacity created by rotation of the inner blades 25 and shape of conduits 28, and inner channel 27 since it is contemplated that only the slurry will be drawn into the conduits 28 and inner channel 27.

Due to the shape and structure of the rotor 21, the rotor may be sized to be a smaller diameter than conventional rotors. The rotors may also, or alternatively, be rotated at lower speeds than conventional rotors due to the improved hydrodynamic design and performance of agitating slurry provided by embodiments of the rotor 21. Further, the rotor may provide improved flotation kinetics as compared to conventional rotor designs due at least in part to the use of multiple slurry flows generated by rotation of the inner blades 25 and outer blades 24 of the rotor 21.

Embodiments of the rotor 21 were found to provide a substantially greater ability to recover minerals during flotation machine operations. Testing was conducted on an embodiment of the rotor 21 and found the embodiment of the rotor 21 greatly improved mineral collection from a tank of a flotation cell as compared to the same cell having a conventional rotor for the recovery of minerals in certain types of slurries. Embodiments of the rotor were found to be particularly effective for processing slurry containing minerals in conditions that are typically difficult to recover via flotation machines with conventional rotors. For example, embodiments of the rotor were found to be particularly effective for small bubble generation, which improved mineral recovery of fine particulates from the slurry retained in a flotation cell. It is contemplated that the improvements provided by embodiments of the rotor 21 in flotation cell performance also permit embodiments of the rotor 21 to be fabricated at smaller diameters than conventional rotors, which may help the rotor provide a further reduction in cost associated with the manufacture of the rotor and operation of the rotor.

Another embodiment of a rotor 41 that may be utilized in rotation mechanisms 8 used in flotation machines may be appreciated from FIGS. 6-9. The rotor 41 may include a body 42 formed of metal that has an upper portion 44 sized and configured for attachment to a column 61 of a rotation mechanism 8 and a central duct 45 for receiving air or gas that may be passed through the column to which the rotor is attached. The duct 45 may also be considered a central channel, conduit, or passageway. The air passes through the duct 45 and out one or more outlets 46 formed in the rotor body 42. Preferably there is an outlet positioned between immediately adjacent outer blades 48 that extend from the rotor body 42.

The outer blades 48 may be formed on the body, adhered to the body, cast with the body, integrally attached to the body or otherwise attached to the body via one or more fastening mechanisms such as welding, rivets, or other fasteners. The outer blades 48 may be members such as walls or profiled fins that agitate the slurry when the rotor 41 is rotated.

Each of the outer blades 48 has an outer edge 49. As shown in FIGS. 6-9, the outer edge 49 extends outwardly from adjacent the upper portion of the rotor body 42 at an upper portion 50 of the outer edge 49 to an outermost position 51. The outward extension from the upper portion 50 adjacent the rotor body 42 to the outermost position 51 should extend along a curved path to a location positioned below the upper portion 50. This location should be positioned such that the portion of the outer blade 48 that extends from the outermost portion 51 to the upper portion 50 should be at least 30% of the overall height H of the outer blade 48. From the outermost position 51, the outer edge 49 extends generally inwardly to a lower position 53 and innermost position 55 located adjacent the rotor body 42. The overall height of the portion of the outer blade that extends from the outermost position 51 to the lower position 53 should be at least 50% of the height H of the outer blade 48. The height of the portion of the outer blade 48 that extends from the lower portion 53 to the innermost position 55 of the outer edge 49 should be 20% or less of the overall height H of the outer blade 48. The outer edge 49 is preferably curved to define a generally half-hearted shape as may be appreciated from FIGS. 6, 7, and 8. A generally half heart shape may be understood to be the shape of the outer blades 48 as shown in FIGS. 6-9.

The upper portion 50 of the outer edge tapers inwardly toward the rotor body 42 and the lower portion of the outer edge 49 is positioned below the outermost position 51 also tapers inwardly to the rotor body 42. An intermediate section 48*a* of each outer blade 48 that includes the outermost position 51 is therefore wider than the upper section 48*b* and lower section 48*c* of the outer blade 48. It should be understood that the upper portion 50 of the outer edge 49 may be a portion of the upper section 48*c* and the lower position 53 and inner position 55 of the outer edge 49 may be portions of the lower section 48*c*.

The shape of the outer edge 49 of each outer blade may be defined as a curved path along with the outer edge travels. As may be seen from FIG. 9, the curved path of outer edges 49 may be defined by a series of equations for different values of parameters x and y used in a formula. The values for parameters x and y are normalized by rotor radius. For instance, the upper portion 50 of the outer edge 49, which is referred to as Section 1 in FIG. 9, may be defined by the formula $y=10.974*x^6+10.512*x^5-43.377*x^4+28.863*x^3-4.6993*x^2+0.3068*x+0.5459$. The value of x ranges from 0 to 0.7 for the upper portion 50 and may define the height and width of the upper section 48*b* of the outer blade.

The outermost position 51 of the outer edge 49 may extend for a certain distance, or height, to define a portion of a certain height of the outer edge 49 that is in the outermost position. The outermost position 51 is referred to as Section 2 in FIG. 9. The value of y may equal 1 for a value of x that ranges for 0.7 to 0.96, which may define the height of the intermediate section 48*a* of the outer blade.

Figure 9:
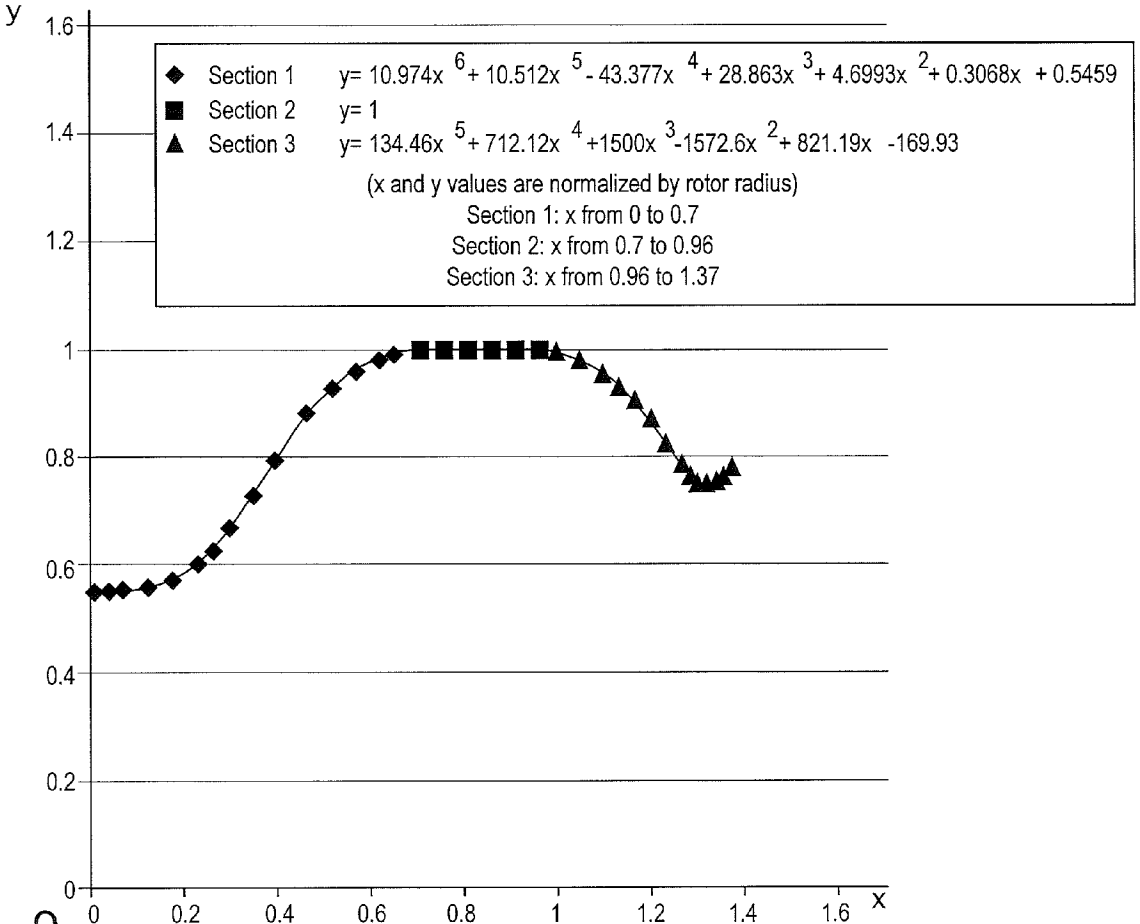
FIG. 9 is a graph illustrating the curved path defined by the outer edges of the outer blades of the second exemplary embodiment of the rotor. The x and y values of the graph are normalized by rotor radius.

The lower section of the outer edge 49 of each outer blade, which is referred to as Section 3 in FIG. 9, may be defined by the formula $y=134.46*x^5-712.12*x^4+1500*x^3-1572.6*x^2+821.19*x-169.93$. The values for parameters x and y are normalized by rotor radius. The value of x ranges from 0.96 to 1.37 for the lower section of the outer edge that extends from the outermost position 51 to the inner position 55 and may define the height and width of the upper section 48*b* of the outer blade.

It should be understood that the values of x for the above noted formulas may define a height of the outer blades and the values of y may define the width of the outer blades normalized for the maximum radius of the rotor, which is the radius as measured to the outermost position 51 of the outer blade. The height of the outermost position 51 of the outer edge may extend to 18.9% of the overall height of the outer blade and define the intermediate section 48*a* of the outer blade. The height of the upper portion 50 that tapers from the upper portion of the outer blade to the highest point of the outermost position 51 of the outer edge 49 may extend along 51.1% of the overall height of the outer blade and may define the upper section 48*b* of the outer blade. The lower section of the outer edge that tapers inwardly from the lowermost point of the outermost position 51 of the outer edge may extend generally inwardly from this position as may be appreciated from FIGS. 6-9 for 29.3% of the height of the outer blade and may define the lower section 48*c* of the outer blade.

Figure 8:
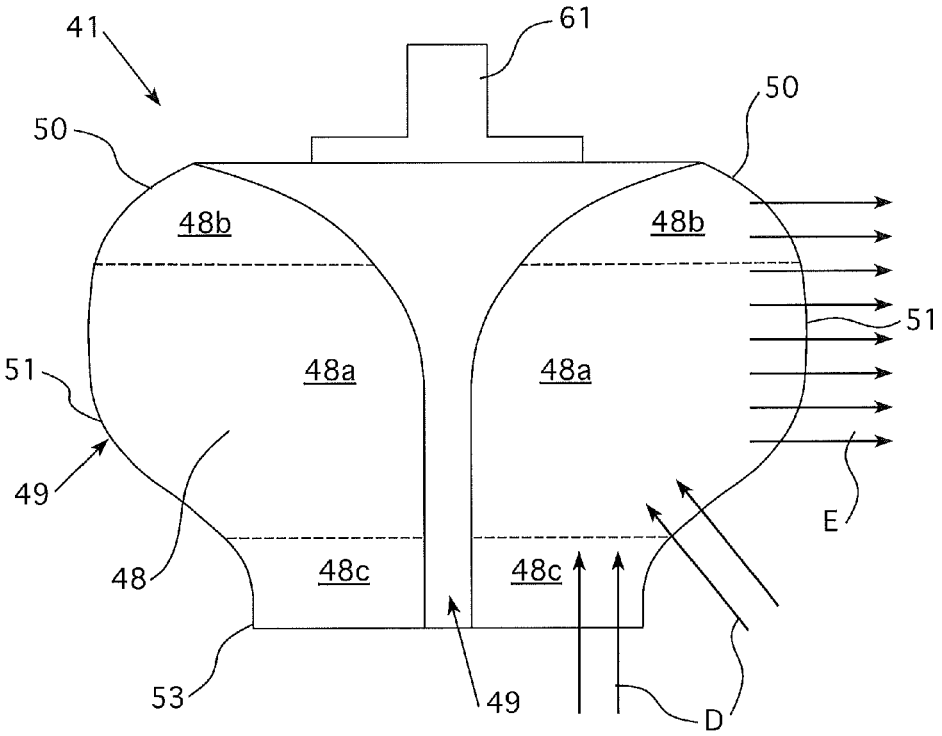
FIG. 8 is a schematic side view of the second exemplary embodiment of the rotor that includes indicia illustrating slurry-gas flow patterns from rotation of the rotor.

As may be seen in FIG. 8, rotation of the rotor 41 may create a flow D of slurry that is pushed outwardly by the intermediate section 48*a* of the outer blades 48 and gas expelled from outlets 46 so that a flow of slurry E is pushed further away from the rotor and column 61 than flows generated by conventional rotor designs. The tapered shape and the width of the intermediate sections 48*a* of the outer blades help spread the gas and slurry jet generated by the gas exiting the outlets 46 and rotation of the outer blades 48 so that the jet is spread out over a much larger area than conventional designs so that a uniform turbulence profile is generated when the rotor rotates at steady state conditions. The uniform turbulence profile enhances gas dispersion, improves bubble-particle collisions, and reduces bubble-particle detachment. Additionally, the velocity spike in the exit stream E is suppressed. This is beneficial as the velocity spike experienced by conventional rotors consumes power but does little to improve flotation performance.

Embodiments of the rotor 41 were found to consume substantially less horsepower than conventional rotor designs. Indeed, testing was conducted on an embodiment of the rotor 41 compared to conventional rotors and the results of that testing found the embodiment of the rotor 41 consumes much less horsepower as compared to conventional rotors, which provides a substantial reduction in operational costs associated with operation of the rotor and flotation cell using such a rotor. Further, the testing showed that embodiments of the rotor 41 provided an improved recovery of coarse particles from a slurry of a flotation cell as compared to conventional rotor designs.

It should be understood that numerous changes may be made to the embodiments of the rotor and flotation machine discussed above while still being within the scope of the following claims. For instance, the shape and geometry of the tanks of the flotation cells may be any of a number of different shapes and sizes. As another example, the type of material to be recovered by the cells of a flotation machine may be any of a number of different minerals or metals such as, for example, copper, iron, coal, a base metal, a special metal, other minerals or other types of metal. As yet another example, the column used to rotate the rotor may be any of a number of rotatable members such as rods or shafts that are part of a rotation mechanism used to rotate the rotor. As yet another example and as those of at least ordinary skill in the art will appreciate, the types of reagents, types of depressants/activators, use of different pH levels, use of different collectors, frothers, or modifiers in the slurry may be utilized as needed to meet different material recovery objectives, or other design objectives. As yet another example, the number of external blades for an embodiment of the rotor may be two, five, seven, eight or any other number that is more than two as needed to meet one or more design objectives. Similarly, the number of internal blades of an embodiment of the rotor that may be utilized may be any number that is needed to meet one or more design objectives. As yet another example, the body of the rotor and the external and internal blades may be formed of a metal such as steel or an alloy or may be formed from another material that is found to be suitable to meet a particular design objective.

While certain present preferred embodiments of the flotation machines, rotors and methods of making and using the same have been shown and described above, it is to be distinctly understood that the invention is not limited thereto but may be otherwise variously embodied and practiced within the scope of the following claims.

What is claimed is:

1. A flotation machine comprising:

at least one flotation cell, each of the at least one flotation cell comprising:

a tank that is sized to retain a slurry comprised of a liquid mixed with at least one solid material;

a rotor positioned in the tank, the rotor rotated to agitate the slurry to facilitate formation of bubbles, the rotor comprising:

a body having an inner channel and a lower opening;

a plurality of inner blades attached to the body, the inner blades being positioned inside the body adjacent the inner channel, the inner blades at least partially defining a plurality of conduits within the body, the conduits being in communication with the inner channel, each of the conduits being defined within the body to extend from an inlet interfacing with the inner channel within the body to an outlet on an external surface of the body so that slurry pulled into the lower opening via rotation of the rotor passes through the inner channel and is ejected from the external surface of the body via the conduits at locations positioned above the lower opening; and a plurality of outer blades attached to the body such that the outer blades rotate when the body is rotated, the outer blades being positioned above the lower opening, the outer blades extending outwardly from the external surface of the body away from the outlets of the conduits; and wherein the body also has passageways separated from the conduits, each of the passageways having an inlet to receive at least one gas and an outlet to emit the at least one gas received via the inlet, the outlet of each passageway being spaced apart from the outlets of other passageways, the outlet of each passageway being positioned in the body between immediately adjacent outer blades.

2. The flotation machine of claim 1 wherein the outer blades are spaced apart from one another along the external surface of the body of the rotor and wherein the inner blades are spaced apart from each other and define the conduits inside the body.

3. The flotation machine of claim 1 wherein the outer blades are positioned so that the outer blades are offset relative to the inner blades.

4. The flotation machine of claim 1 further comprising a column positioned at least partially in the tank, the rotor being attached to the column.

5. The flotation machine of claim 1 wherein the at least one gas is air.

6. The flotation machine of claim 1 wherein the body of the rotor is formed so that the inner blades and outer blades are integral with the body or wherein the inner blades are integrally attached to the body and each of the outer blades are attached to the body via at least one fastening mechanism; and wherein the outer blades extend outwardly horizontally away from the outlets of the conduits.

7. The flotation machine of claim 1 wherein the body is structured so that no air or gas is injected from the passageways into the conduits and no air or gas is injected from the passageways into the inner channel.

8. A rotor for a flotation machine, the rotor comprising:

a body having a lower opening and an inner channel within the body;

a plurality of inner blades attached to the body, the inner blades being positioned inside the body adjacent the inner channel, the inner blades at least partially defining a plurality of conduits within the body, the conduits being in communication with the inner channel to receive slurry from the inner channel, each of the conduits extending from an inlet interfacing with the inner channel to an outlet on the external surface of the body so that slurry pulled into the lower opening of the body passes into the inner channel via rotation of the rotor and subsequently passes out of the inner channel and is ejected from the external surface of the body above the lower opening via the conduits;

a plurality of outer blades attached to the body, the outer blades extending outwardly from the external surface of the body away from the outlets of the conduits; and wherein the body also has passageways, each of the passageways having an inlet to receive air or at least one gas and an outlet to emit the air or at least one gas received via the inlet, the outlet of each passageway being spaced apart from the outlets of other passageways, the outlet of each passageway being positioned in the body between immediately adjacent outer blades.

9. The rotor of claim 8 wherein the outer blades are spaced apart from one another along the external surface of the body of the rotor and wherein the inner blades are spaced apart from each other and define the conduits inside the body.

10. The rotor of claim 8 wherein the outer blades are positioned so that the outer blades are offset relative to the inner blades.

11. The rotor of claim 8 wherein the body of the rotor is formed so that the inner blades and outer blades are integral with the body or wherein the inner blades are integral to the body and each of the outer blades are attached to the body via at least one fastening mechanism; and wherein the outer blades extend outwardly horizontally away from the outlets of the conduits.

12. The rotor of claim 8 wherein the body is structured so that no air or gas is injectable from the passageways into the conduits and so that no air or gas is injectable from the passageways into the inner channel when the rotor is rotated.

13. A flotation machine comprising:

at least one flotation cell, each of the at least one flotation cell comprising:

a tank that is sized to retain a slurry comprised of a liquid mixed with at least one solid material;

a rotor positioned in the tank, the rotor rotated to agitate the slurry to facilitate formation of a bubbly flow used to generate a froth, the rotor attached to a column, the rotor comprising:

a body; and a plurality of outer blades, each of the outer blades extending along a height of the blade outwardly from an external surface of the body to an outer edge, the outer edge extending from adjacent an upper portion of the external surface of the body of the rotor to an outermost position located below the upper portion of the external surface of the body of the rotor along a curved path, the outer edge extending inwardly from the outermost position to which the outer edge extends to adjacent a lower portion of the external surface of the body of the rotor along the curved path, the lower portion of the external surface of the body of the rotor being located below the outermost position to which the outer edge extends and is positioned inward relative to the outermost position of the outer edge; and wherein the outer edge extends along the curved path as defined by the formulas:

$y=10.974*x6+10.512*x5-43.377*x4+28.863*x3-4.6993*x2+0.3068*x+0.5459$ when $x$ is valued from 0 to 0.7;

y=1 when x is valued from 0.7 to 0.96;

$y=134.46*x5-712.12*x4+1500*x3-1572.6*x2+821.19*x-169.93$ when $x$ is from 0.96 to 1.37; and wherein x and y are normalized by a maximum radius of the rotor, x is a height of the outer blade and y is a width of the outer blade.

14. The flotation machine of claim 13 wherein each outer edge defines a smooth outer surface of the blade and at least partially defines a shape of the outer blade such that the outer blade is generally half-heart shaped.

15. The flotation machine of claim 13 wherein the outer blades are sized and shaped such that the rotor suppresses a velocity spike in an exit stream of agitated slurry formed via rotation of the rotor.

16. The flotation machine of claim 15 wherein rotation of the rotor at steady state defines a uniform turbulence profile within the slurry.

17. The flotation machine of claim 13 wherein the rotor has a plurality of outlets for emitting air, each of the outlets positioned between immediately adjacent outer blades.

18. A rotor for a flotation machine comprising:

a body;

a plurality of outer blades attached to the body, the outer blades extending outwardly along a height of the blade from an external surface of the body to an outer edge;

the outer edge extending from adjacent an upper portion of the external surface of the body of the rotor along a curved path to an outermost position located below the upper portion of the external surface of the body of the rotor and the outer edge extending inwardly along the curved path from the outermost position to which the outer edge extends to adjacent a lower portion of the external surface of the body of the rotor; and the lower portion of the external surface of the body of the rotor being located below the outermost position to which the outer edge extends;

wherein the outer edge extends along the curved path as defined by the formulas:

$y=10.974*x6+10.512*x5-43.377*x4+28.863*x3-4.6993*x2+0.3068*x+0.5459$ when $x$ is valued from 0 to 0.7;

y=1 when x is valued from 0.7 to 0.96;

$y=134.46*x5-712.12*x4+1500*x3-1572.6*x2+821.19*x-169.93$ when $x$ is from 0.96 to 1.37; and wherein x and y are normalized by a maximum radius of the rotor, x is a height of the outer blade and y is a width of the outer blade.

19. The rotor of claim 18 wherein each outer edge defines a smooth outer surface of the blade and at least partially defines a shape of the outer blade such that the outer blade is generally half-heart shaped.

20. The rotor of claim 18 wherein the outer blades are sized and shaped such that the rotor suppresses a velocity spike in an exit stream of agitated slurry formed via rotation of the rotor.

21. The rotor of claim 18 wherein the rotor is shaped so that rotation of the rotor at steady state defines a uniform turbulence profile within the slurry.

22. The rotor of claim 18 wherein the rotor has a plurality of outlets for emitting air, each of the outlets positioned between immediately adjacent outer blades and wherein the lower portion of the rotor is a bottom portion.

* * * * *